US007040248B1

(12) United States Patent
Whitfield

(10) Patent No.: US 7,040,248 B1
(45) Date of Patent: May 9, 2006

(54) HANDICAPPED SPORTING PLATFORM AND TURNTABLE

(76) Inventor: Roger McCurry Whitfield, 490 Barbara Way, Tarpon Springs, FL (US) 34689

( * ) Notice: Subject to any disclaimer, the term of this patent is extended or adjusted under 35 U.S.C. 154(b) by 0 days.

(21) Appl. No.: 11/109,436

(22) Filed: Apr. 19, 2005

(51) Int. Cl.
*B63B 17/00* (2006.01)

(52) U.S. Cl. ..... 114/364; 104/45; 248/349.1

(58) Field of Classification Search ..... 114/364; 104/45; 248/349.1
See application file for complete search history.

(56) References Cited

U.S. PATENT DOCUMENTS 4,753,173 A * 6/1988 James ..... 104/45
5,220,116 A 6/1993 Sheets
5,794,908 A 8/1998 East
6,568,646 B1 * 5/2003 Wess et al. ..... 248/349.1

* cited by examiner

*Primary Examiner*—Lars A. Olson
(74) *Attorney, Agent, or Firm*—Dorothy S. Morse

(57) ABSTRACT

A platform including a rotatable turntable apparatus for attachment to a boat deck, or the cargo space of a pick-up truck or the cargo space of an all terrain vehicle, or other area where a person with impaired mobility needs to experience greater mobility to engage in fishing, boating, wild game hunting or activities that they would otherwise be unable to enjoy. The platform can be used for securely mounting a wheelchair or a fishing type chair to provide a rotational means for persons with impaired mobility. The turntable is reversibly rotated by an electric motor a full 360 degrees. The motor can be independently actuated by a switch located on the turntable within easy reach of the chair occupant or by a switch at another convenient location.

13 Claims, 8 Drawing Sheets

HANDICAPPED SPORTING PLATFORM AND TURNTABLE

CROSS-REFERENCES TO RELATED APPLICATIONS

A Disclosure Document is on file at the U.S. Patent & Trademark Office and benefit thereof is requested. Ser. No. 569336 is assigned to this Disclosure Document and was received by the U.S. Patent & Trademark Office on Jan. 31, 2005.

BACKGROUND OF THE INVENTION

1. Field of the Invention

This invention relates to devices for mounting a wheelchair or fishing chair to a motorized rotatable platform mounted on the deck of a boat whereby a person with impaired mobility can engage in boating related activities, fishing, duck hunting, and the like. However, other applications are also contemplated, such as but not limited to land based wild game hunting, and therefore mounting of the present invention platform is also considered for the cargo space on an all terrain vehicle or pickup truck, and any other area where a person with impaired mobility needs to experience greater rotational mobility to engage in activities that they would otherwise be unable to enjoy. In boating and other applications, the platform includes a motorized turntable upon which a wheelchair or fishing chair is securely mounted so the occupant can be rotated 360 degrees in either direction. Preferably a control switch is positioned adjacent to the chair so the turntable occupant can cause the turntable's rotation, with additional control switches optionally at one or more other locations so another person can rotate the occupant if necessary.

2. Description of the Related Art

While many devices are known for seating boaters without impaired mobility, persons with impaired mobility, especially those in a wheelchair, have few devices providing them with similar options so as to allow them to participate in boating related activities including fishing, duck hunting, or boating in general.

U.S. Pat. No. 5,794,908 to East provides a means for pivotally mounting a wheelchair on a boat deck. However, with this device it is necessary for the wheelchair occupant or another person at his side to unlock, rotate, and lock the wheels to rotate the wheelchair as the situation may require. The present invention overcomes this problem by providing an electric motor as a means of rotation, with a worm gear speed reduction on the electric motor providing the necessary braking by restricting pivotal movement when the motor is not actuated. The wheelchair can be rotated by the turntable occupant actuating a switch within his or her easy reach. A switch at another location on the boat can also be used independently by another person to rotate the wheelchair or fishing chair in situations where the handicapped person may be predisposed with fighting a fish or engaged in some other activity, or in some cases where impairment may prevent the handicapped person from manually actuating the switch on the turntable.

U.S. Pat. No. 5,220,116 to Sheets relates primarily to assisting quadriplegics to support, aim, and fire various weapons from a turntable, with rotational controls that operate via pressure from the quadriplegic's open hand. This invention is manual or battery powered and probably fairly well suited for a target range, but not suited for a boat or motor vehicle or the marine environment. The present invention has advantages over the Sheets invention by being able to utilize the 12 volt D.C. power from the boat electrical system, eliminating the need for a battery on the turntable. Four contact rings and four wired brushes and the associated wiring of the present invention provide the means of getting power to the turntable-mounted control switch and from the switch to the drive motor, providing the impaired person with an electrically powered means for self-rotation, and thereby eliminating the need for manual rotation of the turntable and chair occupant, as provided in the East and Sheets inventions. The present invention also provides a means for securing the wheelchair to the turntable. The present invention further provides the necessary support for a wheelchair and occupant as well as providing stabilization means to overcome the effects of wave action, as well as acceleration and deceleration, while the boat or other mobile vehicle to which it is attached is underway. The present invention also has an advantage over the Sheets invention by providing an area within the platform of some embodiments to accept a boarding ramp enabling the handicapped person to safely and easily board and also exit the platform. The present invention further uses a simple drive means that includes an electric motor with a worm gear speed reduction in conjunction with a synchronous belt and pulley which eliminates the need for chains, sprockets, idlers, gear boxes, and locking mechanisms used by the Sheets invention and which may not be well suited for the marine environment. The reduced number of moving parts susceptible to failure is also an important advantage of the present invention. There is no chair mounting device for boats or land-based motor vehicles with the same features and all of the advantages of the present invention.

BRIEF SUMMARY OF THE INVENTION—OBJECTIVES AND ADVANTAGES

The primary object of this invention is to provide a means for accommodating persons with impaired mobility on a boat, and on land based motor vehicles, so they have 360 degree motorized rotational mobility to engage in fishing, boating, hunting and other activities. A further object of this invention is to provide a motorized rotational means for a wheelchair or fishing chair that is constructed from durable materials that are also resistant to weathering and the corrosive effects of the marine environment. It is a further object of this invention to provide a device that is stable, safe, and secure for the handicapped person. A further object of this invention is to provide a device that is fairly economical to manufacture by using components that are readily available and relatively inexpensive. It is also an object of this invention to provide a device that is easy to use and maintain.

As described herein, properly manufactured and mounted, the present invention handicapped sporting platform provides a means by which a person with impaired mobility can easily rotate 360 degrees in either direction. It includes a turntable mounted to a vertical pivot assembly. When a wheelchair is to be mounted upon the turntable while it is secured to the deck of a boat, the person in the wheelchair comes aboard the boat on a ramp. Wheel chocks and U-bolts are then used to secure the wheelchair to the turntable. A stabilizing ring is bolted to the underside of the turntable. Casters are bolted to the top surface of the stabilizing ring, and the wheels of the casters engage the bottom side of the top deck of the platform thereby stabilizing the turntable during boat acceleration, deceleration, and wake conditions.

The weight of the fishing chair and occupant, or wheelchair and occupant, is supported by casters bolted to the top side of the bottom deck of the platform, with the wheels of the castors engaging the bottom side of the turntable. A reversible 12-volt D.C. electric motor with an attached worm drive speed reduction device is bolted to the bottom deck of the platform, with the drive gear of the worm drive engaging a synchronous belt encircling a driven pulley that is bolted to the bottom side of the turntable providing rotational means for the turntable. The turntable is attached to the top of a hollow shaft that passes up through a flanged pillow block bearing that is bolted to the top of the pivot support hub. The hollow shaft has four contact rings attached to the lower end by a suitable insulating material. Four brush holders are attached to the pivot support hub housing four wired brushes with each brush being urged against its corresponding contact ring by a spring housed within each brush holder. The leads of two of the brushes connect to the boat's 12-volt D.C. electrical system, while the leads of the other two brushes connect to the 12-volt D.C. reversible electric motor. Four wire leads from the contact rings pass up through the hollow shaft and connect to a four conductor connector in a waterproof pivot cap. Two of these wires provide power to a drive motor switch on the turntable, with the other two wires supplying 12-volt D.C. current from the switch on the turntable to the drive motor when the switch is manually actuated. It is also an object of this invention to provide a device that is versatile by means of multiple controls wherein a switch at one or more other convenient locations on the boat or vehicle allows another person to rotate the platform independently from any one of these locations as the need arises.

While the description herein provides preferred embodiments of the present fishing chair and wheelchair mounting invention, it should not be used to limit its scope. For example, variations of the present invention, while not shown and described herein, can also be considered within the scope of the present invention, such as variations in the width and thickness dimensions of its turntable and stabilization ring; and the type of material from which its frame, turntable, casters, and stabilization ring are made. Such components may be made from wood, fiberglass, carbon-fiber, polyvinylchloride, aluminum, copper, brass, stainless steel, and other synthetic or man made materials or a combination thereof. In addition, the type of control switches used with the present invention may include three-position momentary-on/off/momentary-on switches, wireless remote switches, and any other switches may be used that are consistent with the requirements of the present invention. The location and number of additional control switches can also vary by personal requirements and/or type of boat, motor vehicle, or other environment in which it is used. Variations will further occur in the number, type, and placement of threaded inserts, fasteners, casters, and other components depending on weight and space requirements, limitations, and other factors. Thus, the scope of the present invention should be determined by the appended claims and their legal equivalents, rather than being limited to the examples given.

REFERENCE NUMBERS IN THE DRAWINGS

Figure 1:
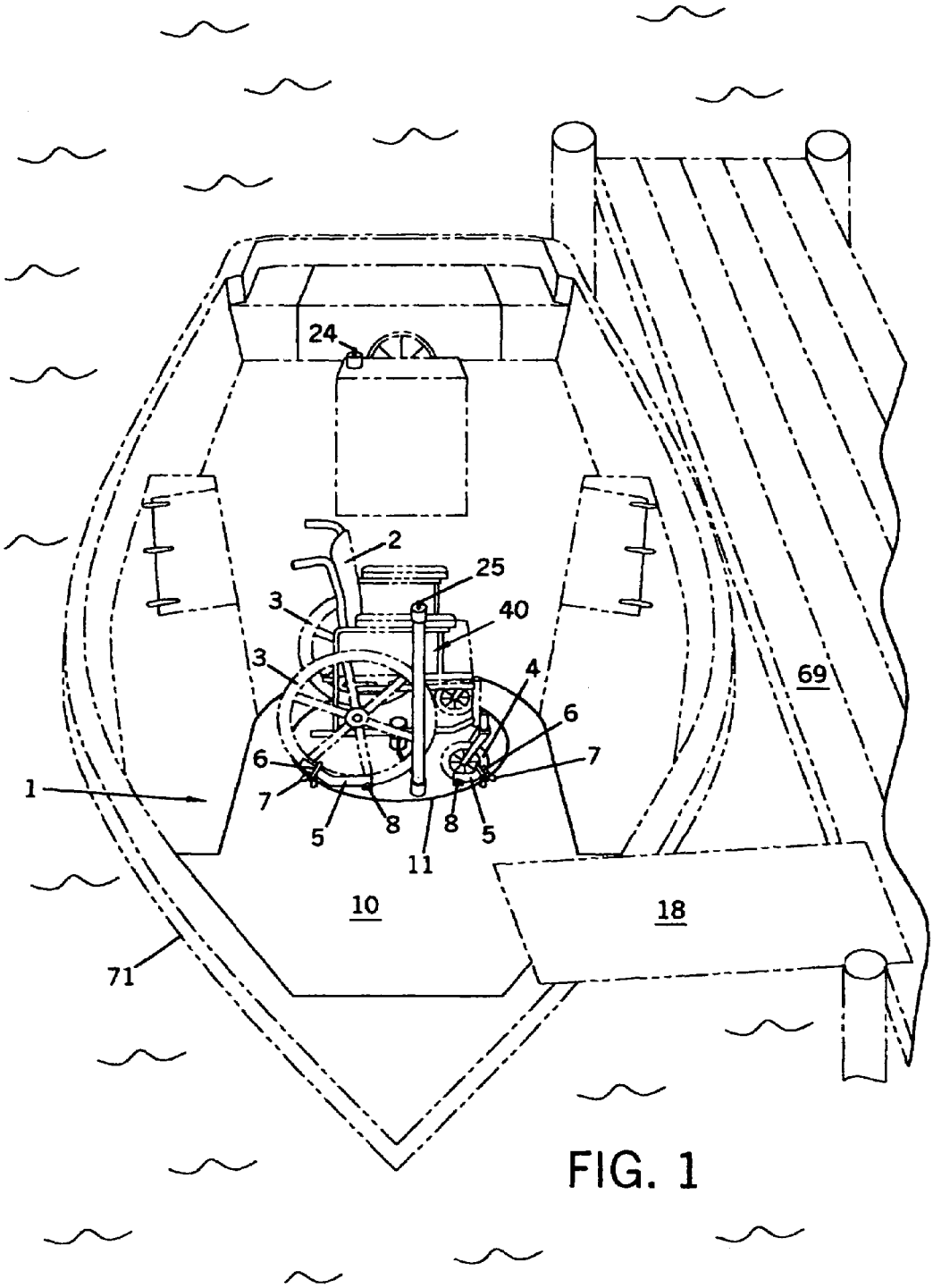
FIG. 1 is a perspective view of a first preferred embodiment of the present invention platform and turntable illustrating a wheelchair mounted to the present invention turntable, as viewed from the bow looking toward the stern of the boat.

| | | | |
|---|---|---|---|
| 1 | platform assembly | 38 | nut for bolt (37) |
| 2 | wheelchair | 39 | hollow pivot shaft |
| 3 | rear wheel of (2) | 40 | tubular post for (25) |
| 4 | front wheel of (2) | 41 | waterproof pivot cap |
| 5 | wheel chocks | 42 | threaded inserts for (40) |
| 6 | U-bolts for (5) | 43 | threaded inserts (48) |
| 7 | wing nuts for (6) | 44 | ring on bottom of (9) |
| 8 | mounting bolts for (5) | 45 | nuts for bolts (36) |
| 9 | fishing chair | 46 | nuts for bolts (61) |
| 10 | top deck | 47 | nuts for bolts (35) |
| 11 | turntable | 48 | eye bolts |
| 12 | bottom deck | 49 | bottom nut on (39) |
| 13 | frame | 50 | flanged pillow block bearing |
| 14 | drive motor | 51 | pivot support hub |
| 15 | wiring harness for (14) | 52 | stabilizing ring |
| 16 | two conductor connector | 53 | four conductor connector |
| 17 | wire leads from (27) | 54 | top nut on (39) |
| 18 | boarding ramp | 55 | casters for (52) |
| 19 | insulating material for (20) | 56 | mounting brackets for (57) |
| 20 | contact rings | 57 | driven pulley for (58) |
| 21 | wiring harness for (20) | 58 | synchronous belt |
| 22 | four conductor connector | 59 | casters for (11) |
| 23 | wiring harness for (25) | 60 | mounting bolts for (56) |
| 24 | control switch | 61 | mounting bolts for (52) |
| 25 | control switch on (11) | 62 | mounting bolts for (52) |
| 26 | brush holder | 63 | mounting bolt for (40) |
| 27 | wired brushes | 64 | mounting bolts for (14) |
| 28 | brush springs | 65 | mounting bolts for (57) |
| 29 | turnbuckles | 66 | nuts for bolts (65) |
| 30 | bolts for (10) | 67 | drive pulley |
| 31 | threaded inserts for (52) | 68 | spacers |
| 32 | threaded inserts for (5) | 69 | pier |
| 33 | threaded inserts for (56) | 70 | platform mounting bolt |
| 34 | bolts for (12) | 71 | boat |

-continued

| REFERENCE NUMBERS IN THE DRAWINGS | |
|---|---|
| 35 bolts for casters (59) | 72 speed reducing worm drive |
| 36 mntg. bolts for (51) | 73 platform mounting bracket |
| 37 mntg. bolts for (50) | |

DETAILED DESCRIPTION OF THE INVENTION

It is the principal object of the present invention to provide a platform with a turntable onto which a wheelchair or fishing chair can be secured to accommodate a person with impaired mobility so as to allow that person to participate in fishing, boating, wild game hunting and other activities that he or she would otherwise be unable to enjoy. Although most of the examples herein relate to marine applications, which were first contemplated, it must be noted that other non-marine applications are equally important to give a person with impaired mobility the opportunity to participate in a wide variety of land based activities. Mounting of the present invention platform and turntable in any land-based motor vehicle applications would be substantially the same as that presented herein for marine applications.

FIG. 1 illustrates the first preferred embodiment of the present invention platform and turntable and showing the platform assembly 1 mounted on the deck of the boat 71. FIG. 1 also illustrates top deck 10 and the turntable 11 mounted within the circular cutout portion of the top deck 10, a wheelchair 2 mounted on the turntable 11, the wheel chocks 5 mounted to the turntable 11 by bolts passing through mounting bolt holes (not shown) in wheel chocks 5, and threaded into the threaded inserts 32. Wheels 3 and 4 of wheelchair 2 are secured to the wheel chocks 5 by U-bolts 6 positioned about the wheels 3 and 4 with the threaded legs of U-bolts 6 then passing through bolt holes (not shown) in the wheel chocks 5 with wing nuts 7 threaded onto the threaded legs of U-bolts 6, thereby securing the wheelchair 2 to the turntable 11. FIG. 1 further illustrates the boarding ramp 18 (shown in phantom) as it would be typically positioned extending from the top deck 10 of the platform 11 to the pier 69 (also shown in phantom) during boarding and disembarking of the wheelchair 2. FIG. 1 further illustrates the drive motor control switch 25 mounted atop the tubular post 40 in a position readily accessible to the occupant of the turntable 11. The switch 24 at the helm of the boat 71 is shown. In the alternative, wireless remote switches (not shown) are also contemplated. Any one of these switches, 24, 25, wireless, or other, can be used to independently actuate the drive motor 14 and thereby cause rotation of the turntable 11 in either direction, with post 40 and switch 25 being removable from the turntable 11 by disconnecting the connector 22 and lifting out the tubular post 40.

Figure 2:
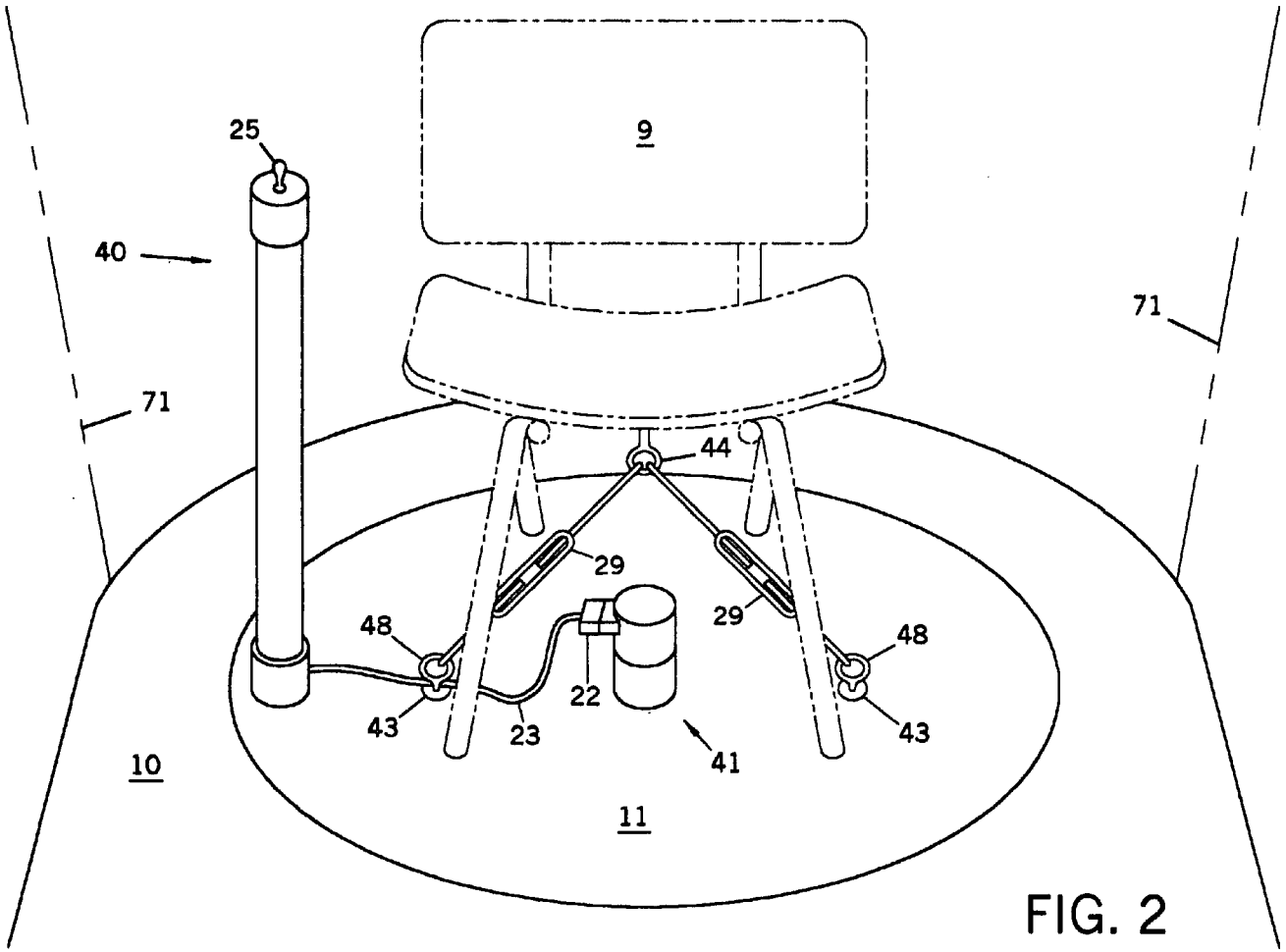
FIG. 2 is a perspective view of a second preferred embodiment of the present invention platform and turntable illustrating a fishing chair mounted to the present invention turntable.

FIG. 2 illustrates the second preferred embodiment of the present invention platform and turntable showing a fishing chair 9 secured to the turntable 11 with eyebolts 48 bolted into threaded inserts 43, with turnbuckles 29 connecting the ring 44 on the bottom of the fishing chair 9 to the eyebolts 48 thereby securing the fishing chair 9 to the turntable 11.

Figure 3:
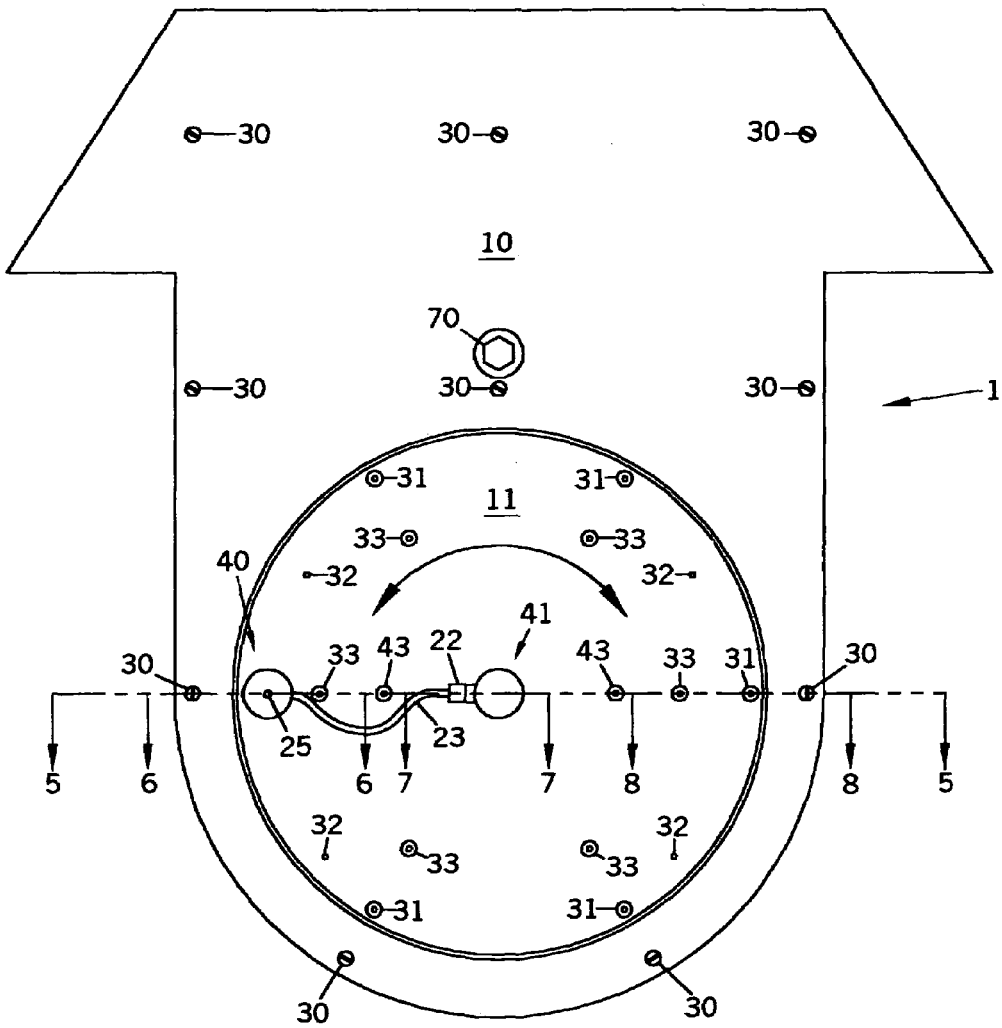
FIG. 3 is a top plan view of the first preferred embodiment of the present invention platform and turntable illustrating the top deck and mounting bolts, and with the turntable showing the placement of the threaded inserts in the present invention turntable.

FIG. 3 is a top view of the first preferred embodiment of the present invention platform and turntable showing the placement of the bolts 30 securing the top deck 10 to the frame 13. FIG. 3 also illustrates bolt 70 that is used to secure the platform 1 to the boat 71. FIG. 3 further illustrates the placement of threaded inserts 31 for the stabilizing ring 52, threaded inserts 32 for the wheel chocks 5, and threaded inserts 33 for the driven pulley mounting brackets 56.

Figure 4:
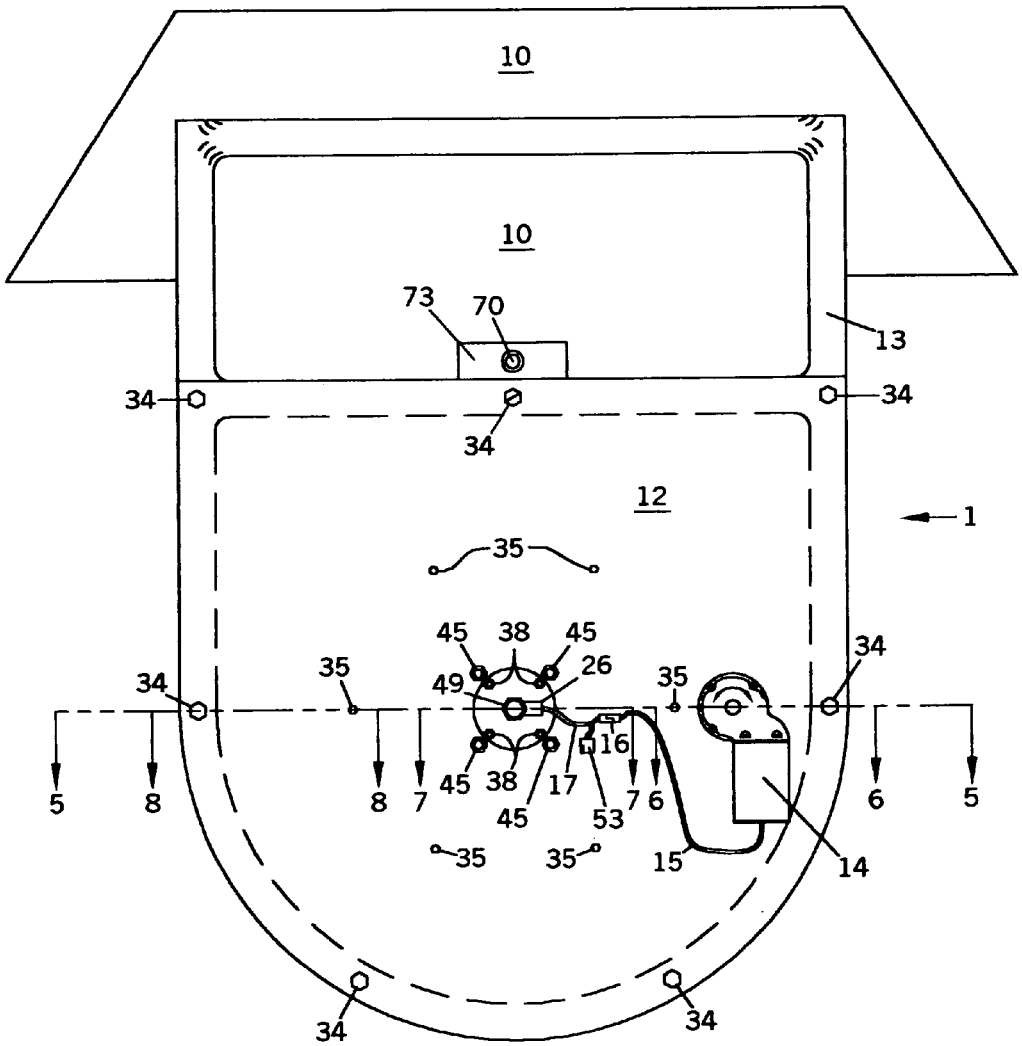
FIG. 4 is a bottom plan view of the first preferred embodiment of the present invention platform and turntable illustrating the bottom deck and mounting bolts, as well as the drive motor and other components.

FIG. 4 is a bottom view of the first preferred embodiment of the present invention platform and turntable showing the placement of bolts 34 securing the bottom deck 12 to the frame 13. FIG. 4 also illustrates bolts 35 for mounting the turntable support casters 59 to the bottom deck 12, bolts 36 for mounting the pivot support hub 51 to the bottom deck 12, and the nuts 38 for the bolts 37 that are used for mounting the flanged pillow block bearing 50 to the top of the pivot support hub 51. FIG. 4 also illustrates a bottom view of the platform mounting bracket 73 and bolt 70 used for mounting the platform 1 to the boat 71, and nut 49 on the bottom of the hollow pivot shaft 39. FIG. 4 further illustrates drive motor 14 with wiring harness 15 and wiring harness 17 connected by two conductor connector 16 that provides the electrical connection between drive motor 14 and the wired brushes 27. FIG. 4 also illustrates the bottom of brush holder 26.

Figure 5:
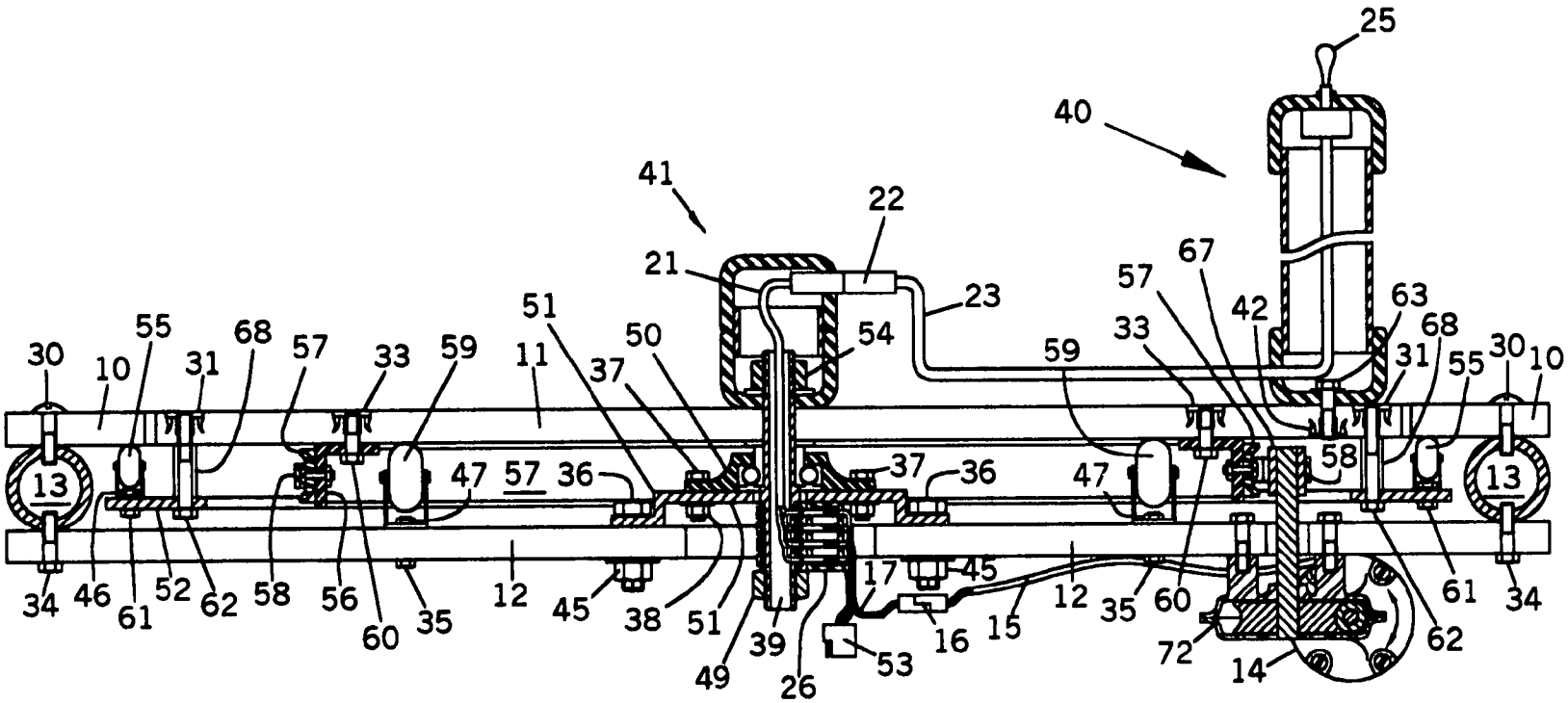
FIG. 5 is a vertical sectional view of the first preferred embodiment of the present invention platform and turntable generally along line 5—5 of FIG. 3 with the components shown in section.

FIG. 5 is a vertical cross section of the first preferred embodiment of the present invention platform and turntable generally along line 5—-5 of FIG. 3, as viewed from the bow looking toward the stern of the boat 71, and showing the components in cross section.

Figure 6:
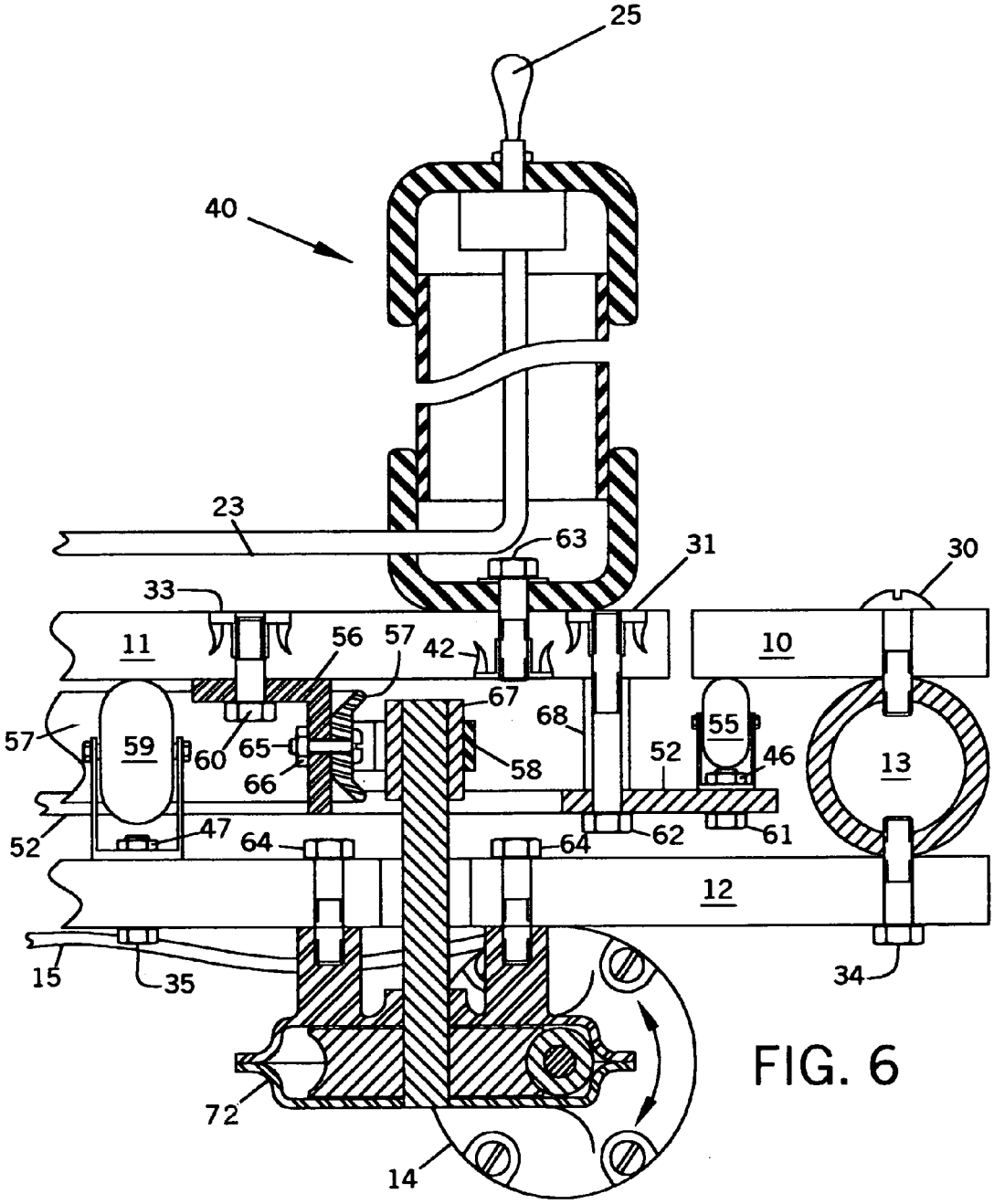
FIG. 6 is an enlarged vertical sectional view of the first preferred embodiment of the present invention platform and turntable generally along line 6—6 of FIG. 3 and illustrating the details of the drive motor and speed reducing worm drive and other components shown in section.

FIG. 6 is an enlarged vertical cross section view of the drive motor side of the first preferred embodiment of the present invention platform and turntable generally along line 6—6 of FIG. 3. Although FIG. 6 shows several bolts 30, 34, 35, and 62–65, the bolt holes through which they pass and into which they are threaded for the most part are difficult to distinguish or otherwise hidden from view in FIG. 6, and for clarity of illustration they remain unnumbered. FIG. 6 shows in detail the speed reducing worm drive 72, with drive motor mounting bolts 64 passing through the bolt holes in the bottom deck 12 and threaded into the threaded mounting bolt holes in the speed reducing worm drive 72. FIG. 6 also illustrates in cross section tubular post 40 with switch 25, four conductor connector 22, and wiring harness 23. Also illustrated is tubular post attaching bolt 63 bolted into threaded insert 42, the stabilizing ring 52 with attaching bolt 62 passing through the bolt holes in the stabilizing ring 52 then passing through spacer 68 and bolted into threaded insert 31, thereby securing the stabilizing ring 52 to the turntable 11, the stabilizing caster 55 with mounting bolt 61 passing through the bolt hole in the stabilizing ring 52 then passing through the caster 55 and threaded into nut 46, thereby securing the stabilizing caster 55 to the stabilizing ring 52. In addition, FIG. 6 illustrates the drive pulley 67 engaging the synchronous drive belt 58, the driven pulley 57 attached to one end of the mounting bracket 56 by bolt 65 passing through the bolt hole in the driven pulley 57 then passing through the bolt hole in the mounting bracket 56 and threaded into nut 66 with bolt 60 passing through the bolt hole in the opposite end of the mounting bracket 56 and threaded into threaded insert 33 thereby securing the mounting bracket 56 and the driven pulley 57 to the turntable 11. FIG. 6 further illustrates in cross section the turntable support caster 59 with bolt 35 passing through the bolt hole in the bottom deck 12 then passing through the turntable support caster 59 and threaded into nut 47 thereby securing the turntable support caster 59 to the bottom deck 12. FIG. 6 further illustrates in cross section bolt 30 passing through the bolt hole in the top deck 10 and into the threaded bolt hole in the frame 13, and bolt 34 passing through the bolt hole in the bottom deck 12 and into the threaded bolt hole in the frame 13 thereby securing the top deck 10 and the bottom deck 12 to the frame 13.

Figure 7:
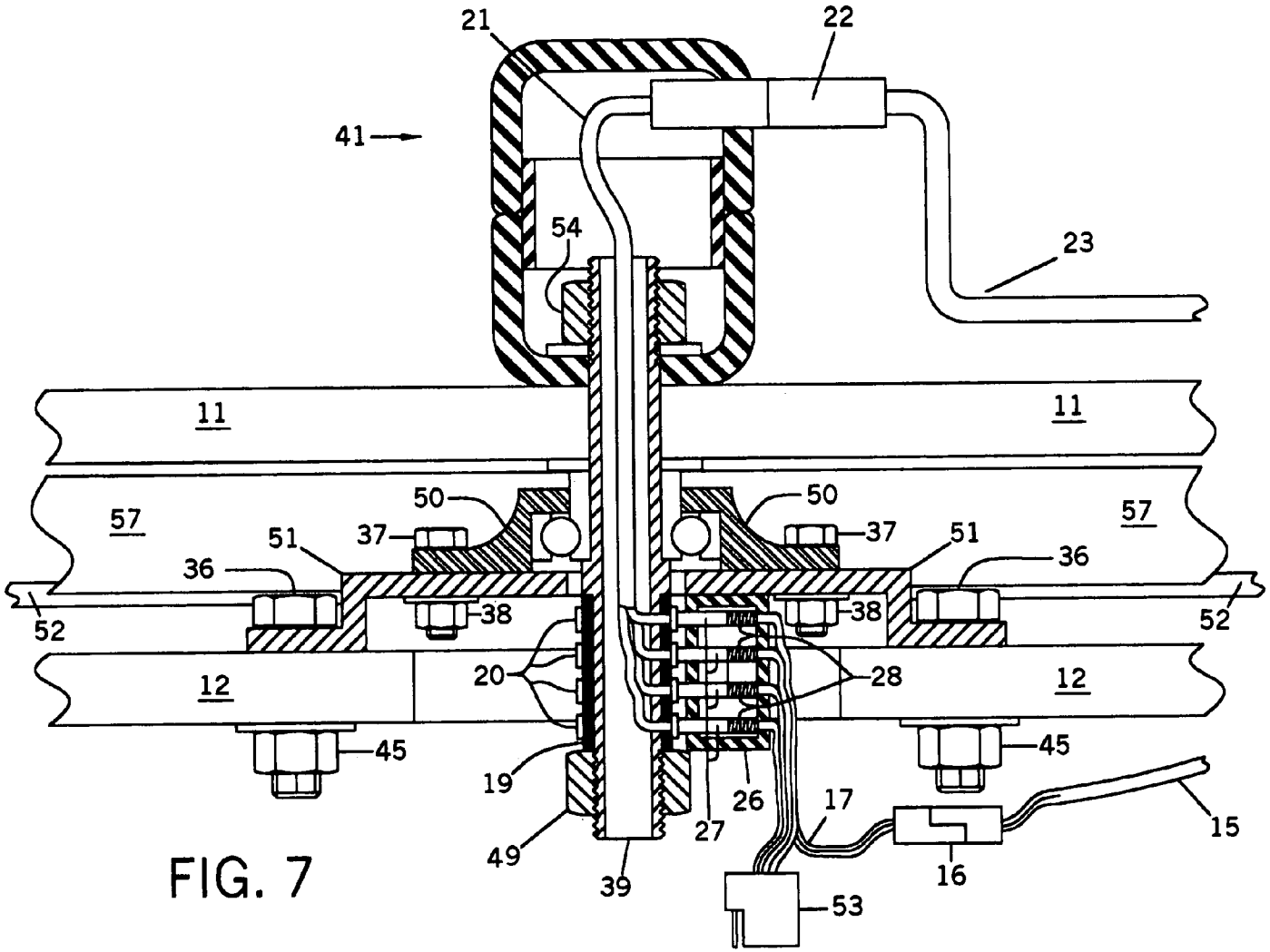
FIG. 7 is an enlarged vertical sectional view of the first preferred embodiment of the present invention platform and turntable generally along line 7—-7 of FIG. 3 and illustrating the details of the vertical pivot assembly and other components shown in section.

FIG. 7 is an enlarged vertical cross section view of the center portion of the first preferred embodiment of the present invention platform and turntable generally along line 7—7 of FIG. 3 showing details of the vertical pivot assembly and other components in cross section. Similar to the treatment of bolt holes in FIG. 6, FIG. 7 shows bolts 36 and 37, however, the bolt holes through which they pass and into which they are threaded are hidden from view in FIG. 7, and remain unnumbered. FIG. 7 further illustrates pivot support hub mounting bolts 36 passing through bolt holes in the flange of the pivot support hub 51 then passing through bolt holes in the bottom deck 12 and threaded into nuts 45 thereby securing the pivot support hub 51 to the bottom deck 12. In addition, FIG. 7 illustrates bolts 37 passing through bolt holes in the flange of the flanged pillow block bearing 50 then passing through the bolt holes in the pivot support hub 51 and threaded into nuts 38 and thereby securing the flanged pillow block bearing 50 to the pivot support hub 51. FIG. 7 further illustrates the lower end of the hollow pivot shaft 39 with nut 49 attached and the hollow pivot shaft 39 passing up through the flanged pillow block bearing 50 then passing through the center hole in the turntable 11 then passing through the hole in the bottom of waterproof pivot cap 41 with nut 54 threaded onto top threaded portion of hollow pivot shaft 39 thereby securing the turntable 11 to the hollow pivot shaft 39 and creating an axis of rotation for the turntable 11. The lower end of the hollow pivot shaft 39 has four separate electrically conductive contact rings 20 made from an electrically conductive material such as but not limited to copper or brass, and attached to the hollow pivot shaft 39 by epoxy 19 or by another suitable non-conductive material, a brush holder 26 mounted in the pivot support hub 51 adjacent to the contact rings 20 houses four wired brushes 27 with each brush being urged into electrical contact with the corresponding contact ring 20 by spring 28. FIG. 7 also illustrates the wiring harness 21 from the contact rings 20 passing up through the hollow pivot shaft 39 and connecting to the four conductor connector 22 housed within the waterproof pivot cap 41, wires 17 from two brushes 27 are connected to the two conductor connector 16 for supplying 12 volt D.C. current from the control switch 25 on the turntable 11 to the drive motor 14, the wires of the four wired brushes 27 connect to the four conductor connector 53 with two of the wires from the four conductor connector 53 being connected to the 12 volt D.C. power supply of the boat 71.

Figure 8:
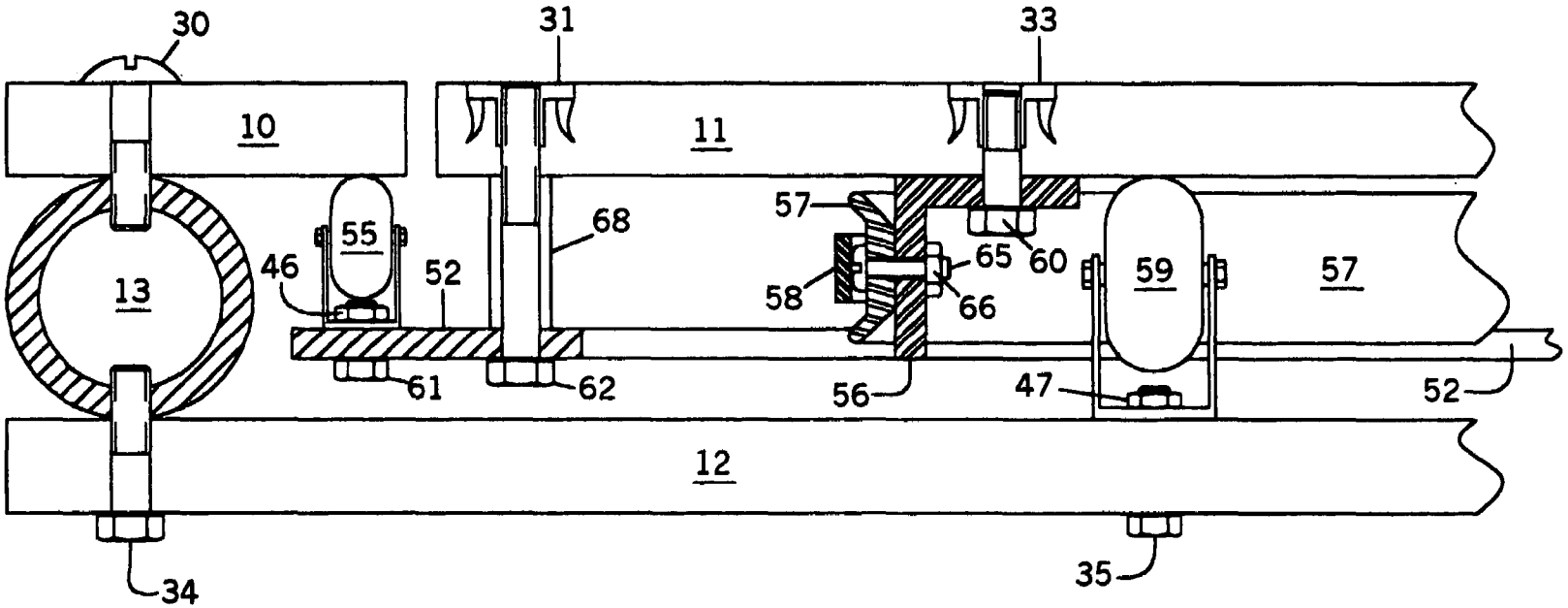
FIG. 8 is an enlarged vertical sectional view of the first preferred embodiment of the present invention platform and turntable generally along line 8—8 of FIG. 3 with components shown in section.

FIG. 8 is an enlarged vertical cross section view of the center portion of the first preferred embodiment of the present invention platform and turntable generally along line 8—8 of FIG. 3 showing an enlarged cross section view, with all of the components in FIG. 8 having been previously described in FIG. 6.

Thus, it has been shown that the present invention handicapped sporting platform and turntable is particularly well suited for use on boats, however it will be understood by those skilled in the art that the present invention is also well suited for other activities and easily adapted for use on a wide variety of mobile conveyances and in a variety of environments, such as but not limited to all terrain vehicles (A.T.V.'s), light trucks, and other land-based vehicles for the purpose of wild game hunting, and perhaps just enjoying the outdoors with 360 degrees of self-controllable rotational mobility.

I claim:

1. A platform and turntable assembly on which wheelchairs and fishing chairs one at a time can be mounted for uninhibited 360 degree rotation to give physically impaired persons greater mobility and an opportunity to participate in activities requiring a greater range of motion than is available to them through use of their wheelchair alone, said platform and turntable assembly comprising:

a) a frame attachable to mobile and stationary surfaces;

b) a top deck comprising a top surface and a bottom surface, said top deck fixedly attached to said frame and comprising a first section having sufficient dimension to support a wheelchair ramp, said top deck further comprising a second section with a circular cutout and a turntable rotatably disposed within said circular cutout, said turntable being substantially flush with said top surface of said top deck and said circular cutout dimensioned slightly larger than said turntable, said turntable also having a plurality of embedded threaded inserts;

c) a stabilizing ring attached to said turntable, said stabilizing ring comprising a plurality of spacers and an outer diameter;

d) a bottom deck comprising a top surface and a bottom surface, said bottom deck fixedly attached to said frame in a position below said top deck;

e) a vertical pivot assembly comprising a pivot support hub fixedly attached to said top surface of said bottom deck, and a flanged pillow block bearing means fixedly mounted on top of said pivot support hub, said vertical pivot assembly further comprises a waterproof pivot cap positioned atop said turntable;

f) a 12 volt D.C. reversible electric motor adjustably mounted to said bottom surface of said bottom deck;

g) a 12 volt D.C. power supply means adapted for providing power to said electric motor; and h) motor actuation means associated with said turntable and adapted for operation by the occupant of a chair secured to said turntable to rotate said turntable in either direction 360 degrees.

2. The platform and turntable assembly as set forth in claim 1 wherein said stabilizing ring further comprises a top surface and a first plurality of casters fixedly attached to and circumferentially disposed about said top surface of said stabilizing ring, said first plurality of casters having wheels projecting upwardly from said top surface of said stabilizing ring so as to make rotational contact with said bottom surface of said top deck.

3. The platform and turntable assembly as set forth in claim 1 wherein said stabilizing ring further comprises a plurality of bolt holes and said stabilizing ring is fixedly mounted to said turntable by a plurality of bolts passing upwardly through said bolt holes in said stabilizing ring, said bolts each further passing through one of said spacers, and said bolts also each threadedly engaging one of said threaded inserts so as to fixedly attach said stabilizing ring to said turntable.

4. The platform and turntable assembly as set forth in claim 1 wherein said turntable has an underside surface and said bottom deck comprises a second plurality of casters fixedly mounted to said top surface of said bottom deck, said second plurality of casters having wheels projecting upwardly so as to make rotational contact with said underside of said turntable and thereby creating a rotational support means for said turntable.

5. The platform and turntable assembly as set forth in claim 1 wherein said turntable has an underside surface and further comprises a drive pulley, a driven pulley, a synchronous belt, and a plurality of mounting brackets fixedly attached to said underside surface of said turntable, and wherein said 12 volt D.C. reversible electric motor has a worm drive speed reduction device with an output shaft, and further wherein said turntable is reversibly rotatable by means of said drive pulley being fixedly mounted to said output shaft of said worm drive speed reduction device, with said drive pulley engaging said synchronous belt that also encircles said driven pulley fixedly attached to said mounting brackets.

6. The platform and turntable assembly as set forth in claim 5 wherein said motor actuation means comprises a first switch mounted atop a hollow tubular member removably mounted to said turntable and a second switch remotely mounted elsewhere whereby actuation of either said first switch or said second switch causes 12 volt D.C. current from said 12 volt D.C. power supply means to be imparted to said 12 volt D.C. reversible electric motor thereby causing rotation of said drive pulley and said synchronous belt, which cause said driven pulley to consequentially transfer rotational energy to said turntable.

7. The platform and turntable assembly as set forth in claim 6 wherein said first switch and said second switch are wireless type switches.

8. The platform and turntable assembly as set forth in claim 1 wherein said turntable further comprises a central hole, said waterproof pivot cap has a base section with a center hole, and said vertical pivot assembly further comprises a hollow pivot shaft having a first end and a second end, and whereby said first end and said second end of said hollow pivot shaft each have an external thread, a nut threadedly engages said external thread on said first end of said hollow pivot shaft, four separate electrically conductive contact rings are concentrically mounted adjacent to said nut on said first end of said hollow pivot shaft by an insulating material, one lead wire is electrically connected to each of said four contact rings, with all said lead wires passing upwardly within said hollow pivot shaft and being electrically connected to a four conductor cable connector within said waterproof pivot cap atop said turntable, and said second end of said hollow pivot shaft passes through said flanged pillow block bearing and also through said central hole in said turntable, and wherein said external thread on said second end of said hollow pivot shaft further extends through said center hole in said base section of said waterproof pivot cap, with a second nut threadedly engaging said external thread on said second end of said hollow shaft, thereby threadedly attaching said turntable to said vertical pivot assembly.

9. The platform and turntable assembly as set forth in claim 1 wherein said vertical pivot assembly further comprises four wired brushes housed within four brush holders fixedly mounted to said pivot support hub, said four wired brushes elastically supported by four springs within said four brush holders that urge each of said four wired brushes to slidably contact a corresponding one of said contact rings, thereby creating an electrical connection thereto.

10. The platform and turntable assembly as set forth in claim 1 wherein said frame is a welded aluminum assembly and comprises by use of a plurality of cross-members an area for positioning said turntable that is dimensioned slightly larger than said outer diameter of said stabilizing ring, said platform and turntable assembly further comprising a bracket and bolt means for attaching said frame to mobile surfaces.

11. The platform and turntable assembly as set forth in claim 1 further comprising four wheels chocks each having at least one bolt hole, a plurality of bolts, a plurality of U-bolts each having a web portion between two threaded legs, and a plurality of wing nuts, and wherein said four wheel chocks are mounted to said turntable by means of at least one of said bolts passing through said at least one bolt holes in said wheel chocks and further threadedly engaging at least one of said threaded inserts in said turntable, with the four wheels of said wheel chair each mounted to a different one of said wheel chocks as a result of said web portions of said U-bolts positioned about each wheel and said threaded legs of said U-bolts passing through said at least one bolt holes in said wheel chocks with each of said threaded legs of said U-bolts being secured in fixed position via threaded attachment to at least one of said wing nuts.

12. The platform and turntable assembly as set forth in claim 1 further comprising a ring, two eyebolts, and two turnbuckles, and wherein for attaching to said turntable a fishing chair with a seat part having a bottom surface, said ring is mounted to said bottom surface of the seat part and said two eye-bolts threadedly engage two of said threaded inserts imbedded in said turntable, with said two turnbuckles interconnecting said eyebolts with said ring.

13. A platform and turntable assembly on which wheelchairs and fishing chairs one at a time can be mounted for uninhibited 360 degree rotation to give physically impaired persons an opportunity to participate in fishing, hunting, and boating activities requiring a greater range of motion that is available to them through use of their wheelchair alone, said platform and turntable assembly comprising:

a) a frame attachable to the deck of a boat;

b) a top deck comprising a top surface and a bottom surface said top deck fixedly attached to said frame and comprising a first section having sufficient dimension to support a wheelchair ramp, said top deck further comprising a second section with a circular cutout with a turntable rotatably disposed within said circular cutout, said turntable being substantially flush with said top surface of said top deck and said circular cutout dimensioned slightly larger than said turntable, said turntable having a plurality of embedded threaded inserts;

c) a stabilizing ring attached to said turntable, said stabilizing ring further comprising a plurality of spacers;

d) a bottom deck comprising a top surface and a bottom surface said bottom deck fixedly attached to said frame;

e) a vertical pivot assembly comprising a pivot support hub fixedly attached to said top surface of said bottom deck, and a flanged pillow block bearing means fixedly mounted on top of said pivot support hub, said vertical pivot assembly further comprises a waterproof pivot cap;

f) a 12 volt D.C. reversible electric motor adjustably mounted to said bottom surface of said bottom deck;

g) a 12 volt D.C. power supply means; and h) motor actuation means associated with said turntable and adapted for operation by the occupant of a chair secured to said turntable.

* * * * *